US006302284B1

(12) United States Patent
Zonshin

(10) Patent No.: US 6,302,284 B1
(45) Date of Patent: Oct. 16, 2001

(54) MODULAR SHELVES SYSTEMS

(75) Inventor: Igal Zonshin, Ramat Hasharon (IL)

(73) Assignee: Julius Engineering Ltd. (IL)

( * ) Notice: Subject to any disclaimer, the term of this patent is extended or adjusted under 35 U.S.C. 154(b) by 0 days.

(21) Appl. No.: 09/523,904

(22) Filed: Mar. 13, 2000

(51) Int. Cl.[7] ..... A47F 5/14

(52) U.S. Cl. ..... 211/187; 211/182; 108/147.11; 108/147.13

(58) Field of Search ..... 211/187, 182, 211/181.1; 108/144.11, 147.12, 147.13, 147.15, 106, 107, 108, 192

(56) References Cited

U.S. PATENT DOCUMENTS 4,582,001 * 4/1986 Leikarts ..... 211/187 X
4,637,323 * 1/1987 Nicely ..... 211/187 X
4,754,712 * 7/1988 Olsen et al. ..... 108/144.11
6,068,143 * 5/2000 Wang ..... 211/187

FOREIGN PATENT DOCUMENTS

0525379-A1 * 2/1993 (EP) .

* cited by examiner

*Primary Examiner*—Daniel P. Stodola
*Assistant Examiner*—Erica B. Harris
(74) *Attorney, Agent, or Firm*—Ostrolenk, Faber, Gerb & Soffen, LLP

(57) ABSTRACT

A modular shelf system comprising a plurality of shelf units mounted to four vertical posts. The shelf units are provided with four hollow corner-pieces configured to fit over cone-shaped collars mounted to the posts. The hollow corner pieces are of an incomplete circumference forming a slot of a width exceeding the outer cross-measure of the posts to enable the lateral withdrawal of any shelf unit from the assembled position thereof.

2 Claims, 6 Drawing Sheets

F16.5

MODULAR SHELVES SYSTEMS

BACKGROUND OF THE INVENTION

The present invention generally relates to racks or shelves. More specifically the invention concerns shelf systems of modular structure, namely those composed of vertically positioned tubular posts onto which a series of horizontal shelf units are mounted by sleeve type connectors, at selectable vertical distances suiting the demands of the user.

Mostly, the posts of the conventional shelves are metal pipes formed with a series of shallow circular recesses at fixed intervals, typically 2" apart from each other. A pair of interlocking half-circular collars are applied, together enveloping the pipe and frictionally held thereagainst by being provided with an inner circular rib configured to fit into the selected circular recesses. The outer surface of the collars is conical, convergently tapering at a slight angle from bottom to top. Four of such pairs are used to define the four corners of the yet-to-be-erected shelf.

Every shelf unit is provided with four hollow, cylindrical corner pieces having an inner surface divergently tapering in the opposite direction (from top to bottom) at the same angle as that of the collars, to form a clamping, wedge-action lock therebetween.

The erection of the shelf systems necessarily proceeds by assembling the bottom-most shelf to four posts that are held in vertical position, whereby the corner pieces are first inserted from above, each around the respective post, and the shelf lowered down to the level of the first set of four collars with which it becomes fastened by the wedge action against each other and the post portion embraced by the collars.

This type of modular shelving, though widely used, suffer the inherent drawback that, once erected, it is impossible to dismantle/assemble any of the shelves, say, for replacement if becoming damaged, without removing all shelves located above it. This of course causes a nuisance to service or maintenance personnel, for example of large hotels or hospitals where the shelving systems of this type are mostly used.

It is thus the prime object of the invention to overcome the above described disadvantage.

It is a further object of the invention to provide a modular shelving system of pretty much the same structure as of the conventional shelves but so modified as to allow the easy and convenient replacement/change of location of any individual shelf, irrespective of its vertical location, without upsetting the construction of the whole system.

SUMMARY OF THE INVENTION

Thus provided according to the invention is a shelf system comprising a plurality of shelf units provided with four hollow corner-pieces configured to fit over cone-shaped collars mounted to four vertical tubular posts, characterized in that the hollow corner pieces are of an incomplete circumference forming a vertical slot of a width exceeding the outer cross-measure of the posts to enable the lateral withdrawal of any shelf unit from the assembled position thereof.

BRIEF DESCRIPTION OF THE DRAWINGS

These and additional constructional features and advantages of the invention will be more clearly understood in the light of the ensuing description of two preferred embodiment thereof, given by way of example only, with reference to the accompanying drawings, wherein.

DETAILED DESCRIPTION OF THE PREFERRED EMBODIMENTS

Figure 1:
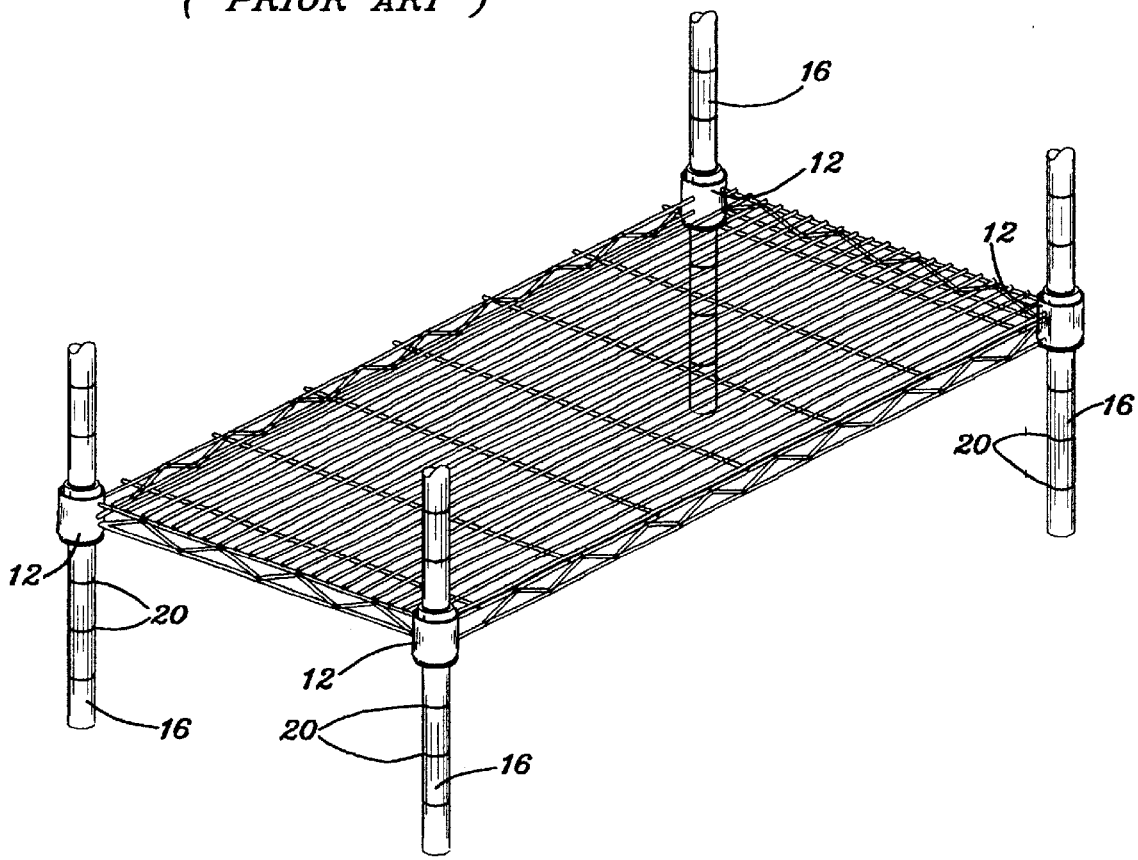
FIG. 1 ( PRIOR ART )
FIG. 1 is a partial perspective view of a conventional modular shelving system.
Figure 2:
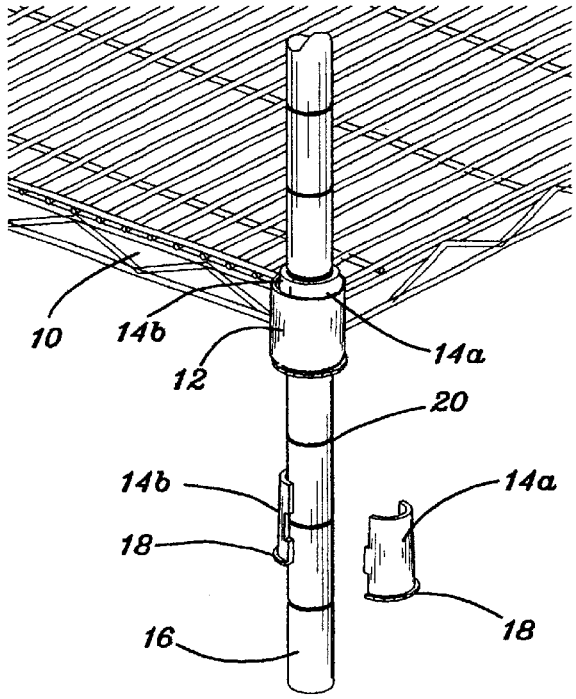
FIG. 2 ( PRIOR ART )
FIG. 2 is a detail of the shelving system of FIG. 1.

Referring briefly to the prior art modular shelving system illustrated in FIGS. 1 and 2, it will be evident that shelves such as denoted 10 are provided with four cylindrical corner-pieces in the form of sleeves 12, dressed-over a collar comprised of two halves 14*a* and 14*b*. The collar members are held by friction against their respective tubular posts 16, by the wedge action attained due to that the outer surface thereof is conical, tapering from bottom to top, and matching with the top to bottom tapering surface of the sleeves 12 inner surfaces. The greater the load on the shelf 10, the stronger the grip applied by the collar halves against the post 16.

As further known, the collar members are formed with a flange or shoulder 18, as well as with inner circular ribs (not shown), fitting circular recesses 20 which the posts 16 are formed with, for enhancing the said friction grip.

It will be thus clearly seen that for assembly/dismantling of a shelf from the system, all of the overlaying shelves must be removed, since the sleeves 12 are thread over the posts, from their top end.

Figure 3:
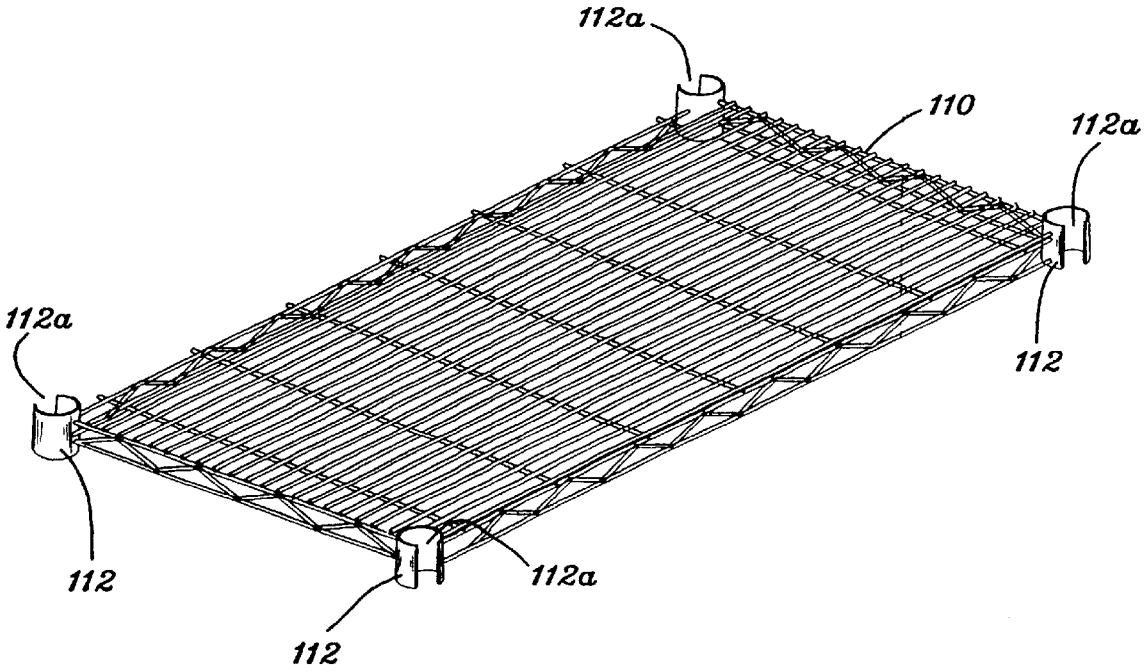
FIG. 3 shows a shelf unit with corner pieces provided according to a first embodiment of the invention.
Figure 4:
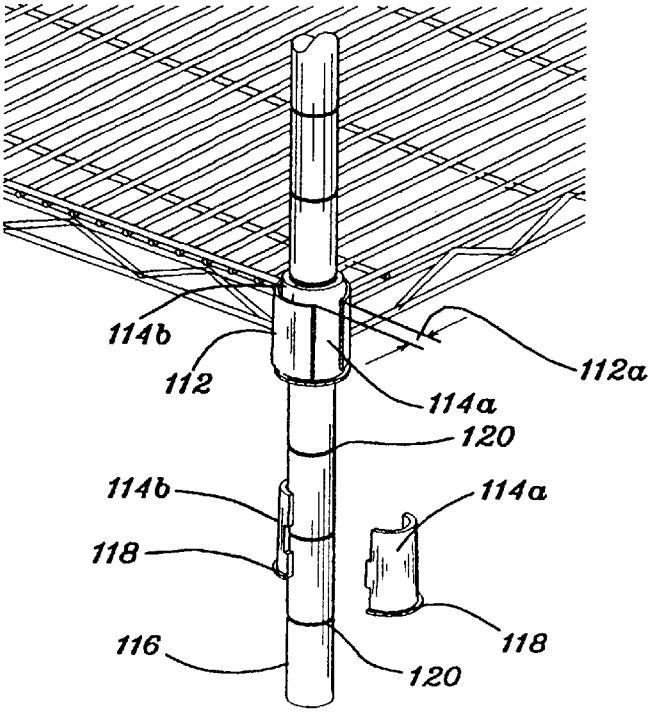
FIG. 4 is a detail showing the mounting of a comer piece of the shelf of FIG. 3 onto a vertical circular post.
Figure 5:
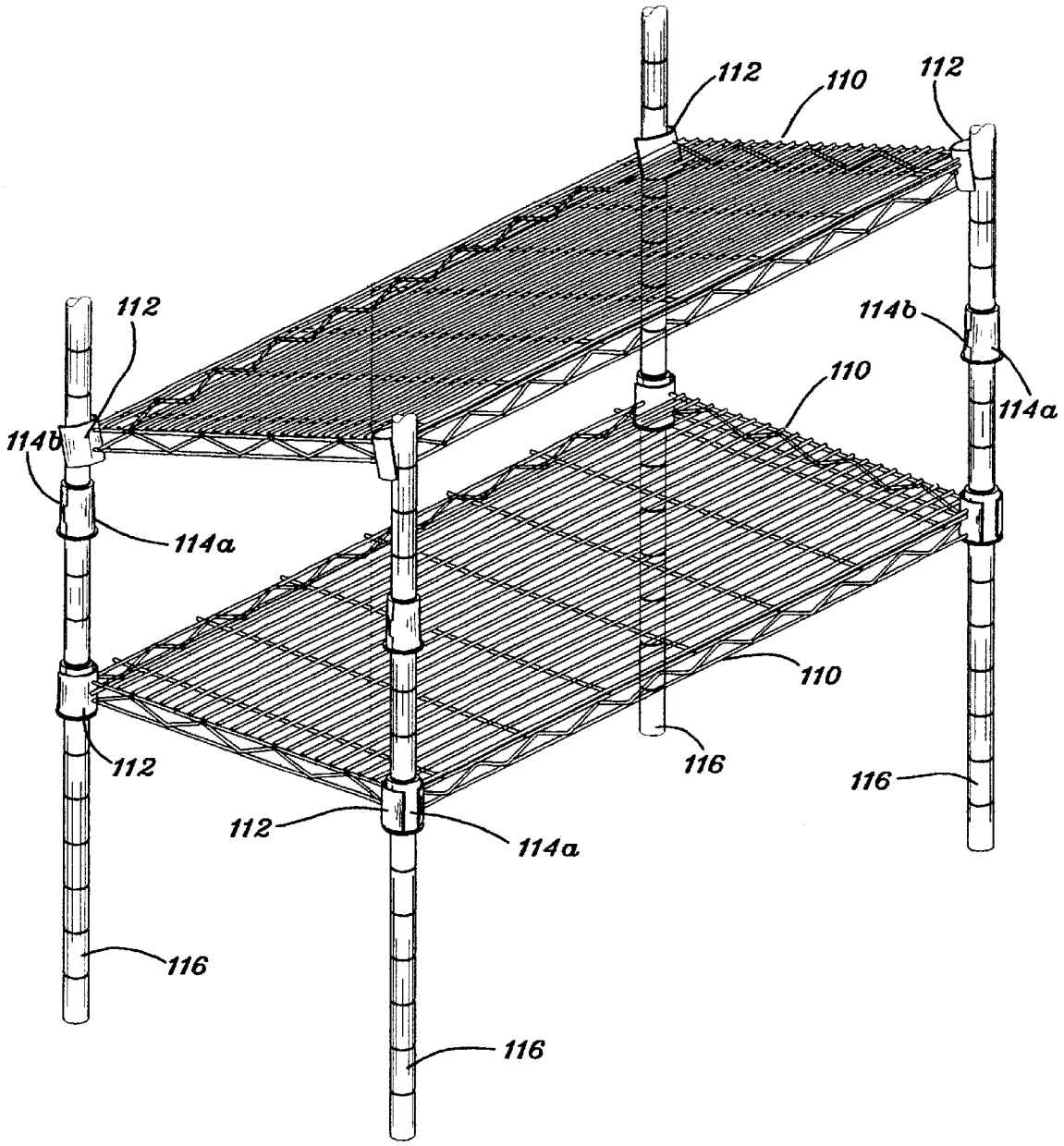
FIG. 5 illustrated the way of dismantling/assembling a shelf unit by using the corner pieces of FIGS. 3 and 4.
Figure 6:
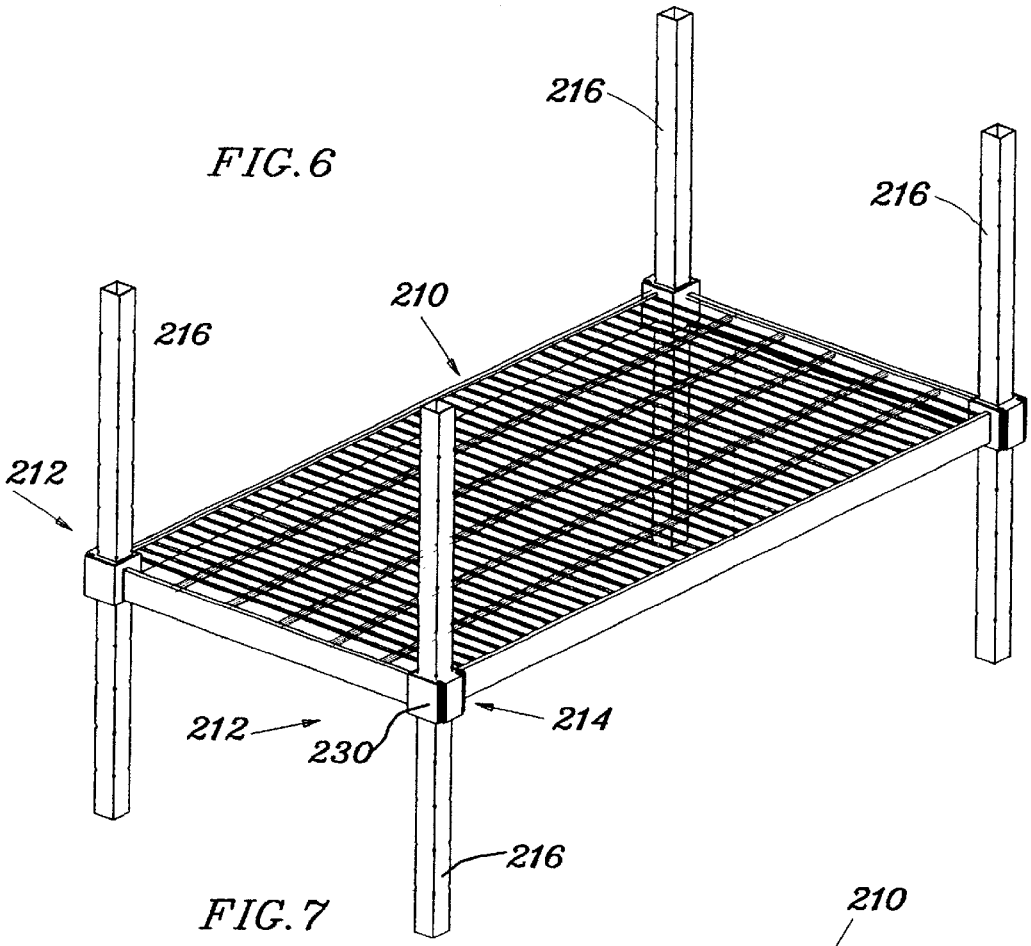
FIG. 6 shows a portion of shelving system provided with corner pieces according to a second embodiment of the present invention.
Figure 7:
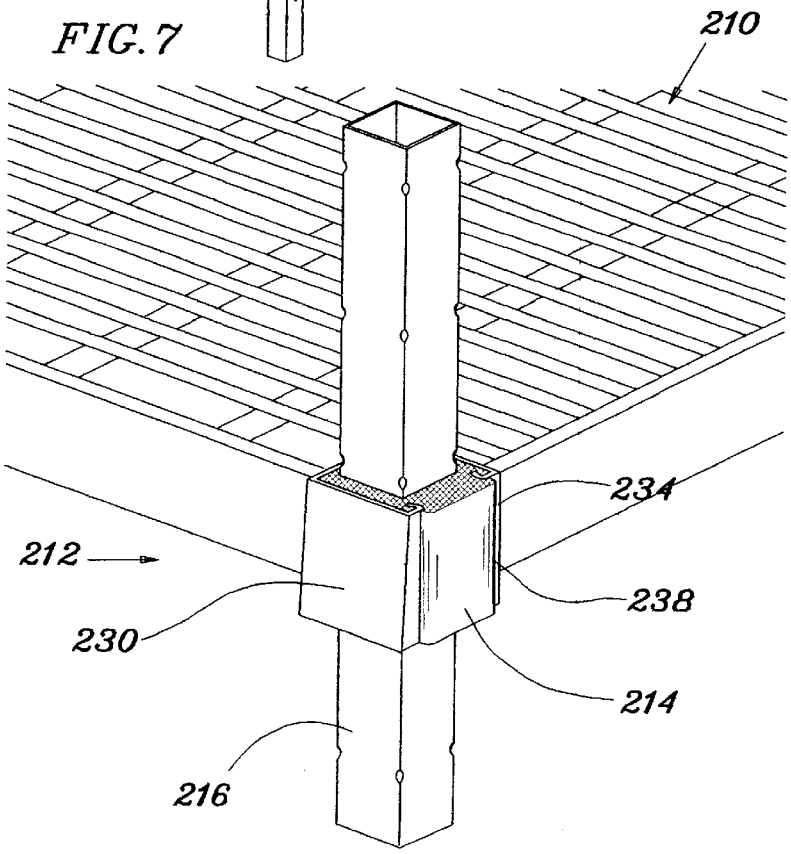
FIG. 7 is a detail of the shelving system of FIG. 6.
Figure 8:
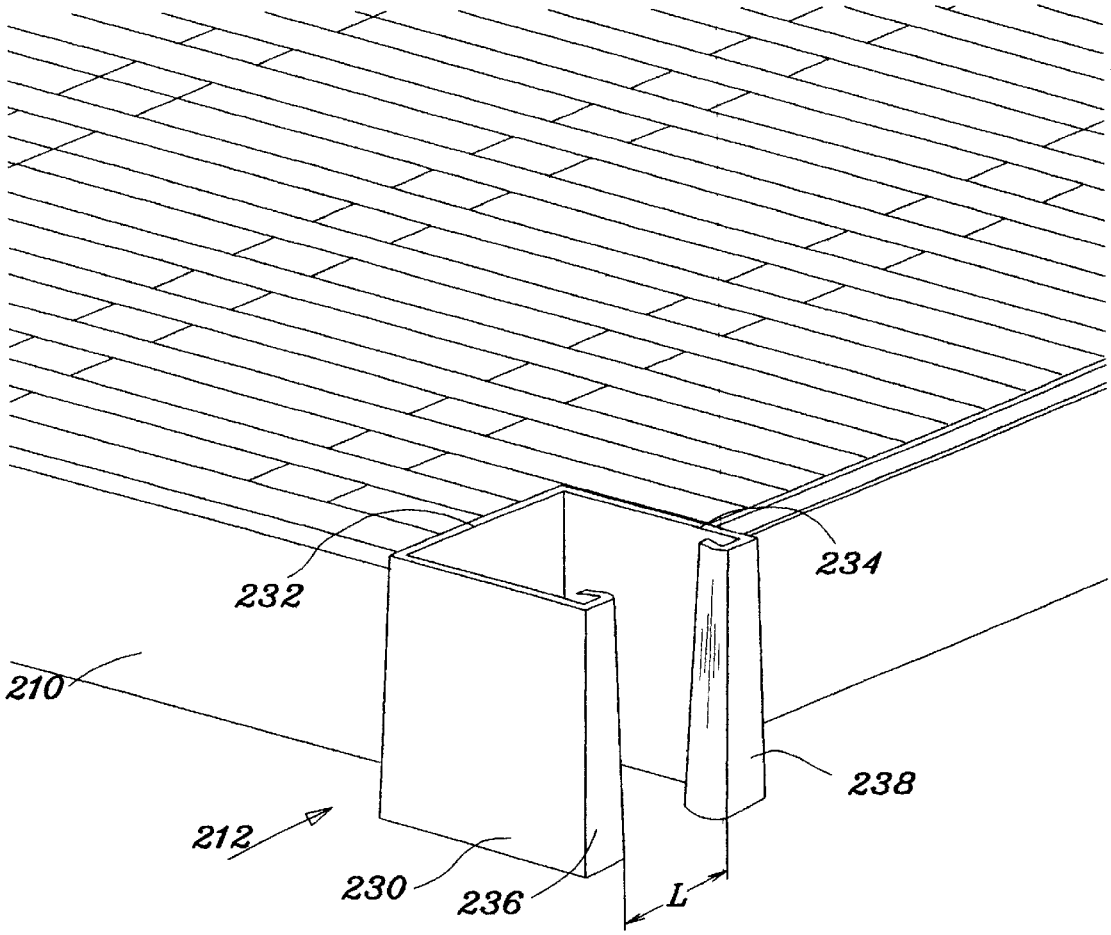
FIG. 8 shows a corner portion of a shelf with a corner piece of FIG. 6.

Reference shall now be made to FIGS. 3–5, wherein reference numerals similar to those of FIGS. 1 and 2 are used for denoting corresponding items, namely with the prefix "1".

Hence, shelf unit 110 is again provided with four generally cylindrical, sleeve-like corner pieces 112. However, unlike the prior art corner-pieces 12, the sleeves 112 do not form a complete, closed cylinder, but having a portion removed, leaving a slot 112*a*. It is essential that the width of the slot 112*a* is somewhat greater than the outer cross-measure of the posts 16, namely, in this case, the diameter thereof.

In all other respects the construction of the remaining shelves structure components, namely of the posts 116 and the collars 114*a*, 114*b*, need not to be changed.

Through this, seemingly minor structural modification, a suprisingly major functional change is attained, as illustrated in FIG. 5: It is now enabled, due to the "split" construction of corner-pieces 112, to dismantle—as well as to install—any of the shelves 110 from/into between adjacent shelves, thus achieving the important advantage over the conventional design, as above explained.

The principles of the present invention are also applicable to shelving systems based on non-circular posts, mainly posts of a square cross-section, as will now be described in conjunction with FIGS. 6–10.

In more detail, corner-piece 212 (see FIG. 8) comprises three side walls 230; 232 and 234, extending at an angle slanting from top to bottom; the fourth wall, directed outwards, is incomplete, consisting preferably of two U-shaped portions, 236 and 238, also following the cone-shape of the other walls—same as the sleeves 112 of the preceding embodiment.

Figure 9:
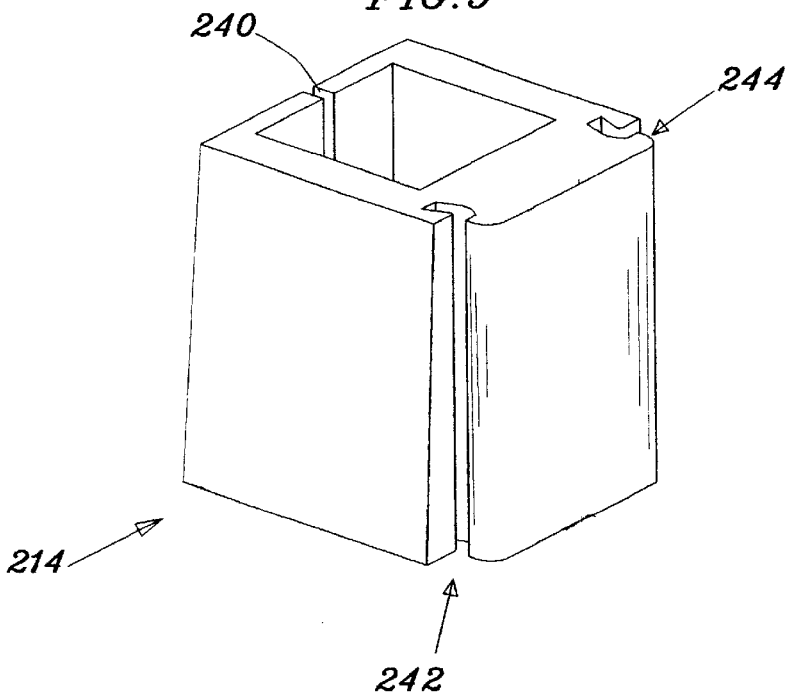
FIG. 9 shows the collar of the system of FIGS. 6 and 7.
Figure 10:
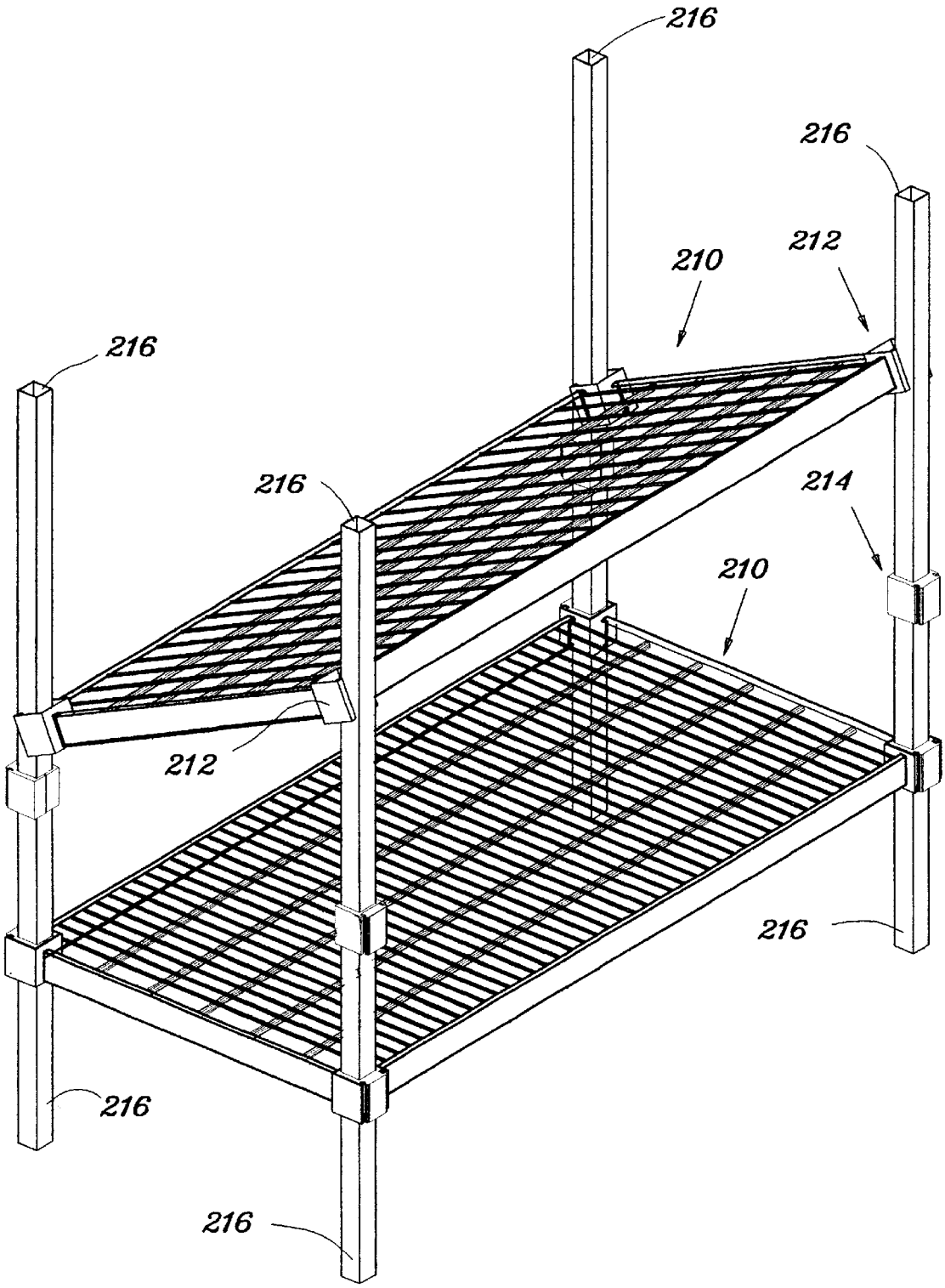
FIG. 10 illustrates the way of dismantling/assembling a shelf unit enabled the corner pieces of FIG. 8.

This distance marked L in FIG. 8 again must exceed the cross-measure of the square posts 216, to enable the lateral withdrawal of the corner-piece 212 (see FIG. 10). Referring now to FIG. 9, the collar 214 is preferably intergral (rather than two-halves as in the former embodiment), molded of an elastic plastic material (or rubber). Its inner contour fits the posts 216, and it can be attached thereto by bending it open along slit 240.

The outer contour of the collar 214 fits into the conical space defined within the corner-pieces 212, thus attaining the wedge action for frictionally interlocking. The U-shaped portions 236 and 238 match into recesses 242 and 244, respectively, and are designed to safeguard the coupling of the corner pieces 212 over the collars 214.

The manner of dismantling a single shelf unit 212 from any position on the shelving system is clearly illustrated in FIG. 10.

While the above description contains many specificities, these should not be construed as limitations on the scope of the invention, but rather as exemplification of the preferred embodiments. Those skilled in the art will envision other possible variations that are within its scope. Accordingly, the scope of the invention should be determined not by the embodiment.

What is claimed is:

1. A modular shelf system comprising a plurality of shelf units provided with four hollow corner-pieces configured to fit over cone-shaped collars mounted to four vertical tubular posts, characterized in that the hollow comer pieces are of an incomplete circumference forming a vertical slot of a width exceeding the outer cross-measure of the posts to enable the lateral withdrawal of any shelf unit from the assembled position thereof;

wherein the tubular posts, collars and hollow corner pieces are four-sided, one of the sides being formed with said slot; and wherein said one side is formed with opposite non-straight portions, complementary recesses being formed in the collars.

2. The modular shelf system of claim 1 wherein the collars are made of an elastic material, and are formed with a slit enabling the lateral mounting thereof onto the posts.

* * * * *